US011125428B2

(12) United States Patent
Zhou et al.

(10) Patent No.: US 11,125,428 B2
(45) Date of Patent: Sep. 21, 2021

(54) LED LAMP FOR VEHICLES

(71) Applicant: Focus Innovation Group LLC, Bastrop, TX (US)

(72) Inventors: Xiaozhong Zhou, Zhongshan (CN); Xin Dong, Bastrop, TX (US)

(73) Assignee: Focus Innovation Group LLC, Bastrop, TX (US)

( * ) Notice: Subject to any disclaimer, the term of this patent is extended or adjusted under 35 U.S.C. 154(b) by 0 days.

(21) Appl. No.: 16/420,122

(22) Filed: May 22, 2019

(65) Prior Publication Data

US 2019/0360681 A1 Nov. 28, 2019

(30) Foreign Application Priority Data

May 23, 2018 (CA) ..... CA 3005802

(51) Int. Cl.

| | |
|---|---|
| ***F21V 19/00*** | (2006.01) |
| ***F21V 29/00*** | (2015.01) |
| ***F21V 29/70*** | (2015.01) |
| ***F21V 29/503*** | (2015.01) |
| ***F21S 41/19*** | (2018.01) |
| ***F21S 41/141*** | (2018.01) |
| ***F21S 45/48*** | (2018.01) |
| ***F21K 9/00*** | (2016.01) |
| ***F21V 17/10*** | (2006.01) |
| *F21Y 115/10* | (2016.01) |

(52) U.S. Cl.

CPC ..... *F21V 29/70* (2015.01); *F21K 9/00* (2013.01); *F21S 41/141* (2018.01); *F21S 41/192* (2018.01); *F21S 45/48* (2018.01); *F21V 17/10* (2013.01); *F21V 19/00* (2013.01); *F21V 29/503* (2015.01); *F21Y 2115/10* (2016.08)

(58) Field of Classification Search

CPC ..... F21V 29/70; F21V 29/503; F21V 17/10; F21V 19/00; F21S 41/192; F21S 41/141; F21S 41/19; F21S 41/194; F21S 45/48; F21S 45/47; F21K 9/00

See application file for complete search history.

(56) References Cited

U.S. PATENT DOCUMENTS

| | | | | |
|---|---|---|---|---|
| 5,041,955 A * | 8/1991 | Devir | F21V 15/04 | 362/306 |
| 6,773,138 B2 * | 8/2004 | Coushaine | F21S 41/194 | 362/656 |
| 7,052,166 B2 * | 5/2006 | Tessnow | F21K 9/68 | 362/647 |
| 7,059,748 B2 * | 6/2006 | Coushaine | F21V 29/74 | 362/294 |

(Continued)

*Primary Examiner* — Arman B Fallahkhair
(74) *Attorney, Agent, or Firm* — NZ Carr Law Office

(57) ABSTRACT

A LED lamp for use in a lamp housing of a vehicle comprises a bulb body and a base. The bulb body comprises one or more light-emitting diodes. The base comprises a mounting portion and a heatsink portion. The mounting portion comprises a collar configured to attachably accept one end of the bulb body, and one or more mounting tabs configured to engage with the lamp housing to secure the LED lamp in place within the lamp housing. The mounting portion is integrally formed with the heatsink portion, and the bulb body is configured to be rotatable within the collar about a longitudinal axis of the LED lamp.

22 Claims, 10 Drawing Sheets

(56) References Cited

U.S. PATENT DOCUMENTS

| | | | | |
|---|---|---|---|---|
| 7,923,907 | B2 * | 4/2011 | Tessnow | F21S 41/192 313/46 |
| 8,651,702 | B2 * | 2/2014 | Wynn | G01N 21/01 362/276 |
| 8,807,808 | B2 * | 8/2014 | Boyd, Jr. | F21S 43/14 362/514 |
| 8,833,990 | B2 * | 9/2014 | Tessnow | F21S 43/14 362/507 |
| 8,919,994 | B2 * | 12/2014 | Wimberly | F21V 13/04 362/232 |

* cited by examiner

LED LAMP FOR VEHICLES

FIELD OF DISCLOSURE

The present disclosure relates to light-emitting diode (LED) lamps. More particularly, the disclosure relates to LED lamps for use in vehicles.

BACKGROUND OF THE DISCLOSURE

Vehicle lights (e.g. headlights, taillights, signal lights, fog lights, etc.) have typically employed halogen lamps as their light source. However, more recently, LED lighting has become more and more popular as a replacement for halogen lamps in vehicle lights. When compared with halogen lamps, LED lighting can provide advantages in energy efficiency, longevity, and light intensity.

In spite of those advantages, one issue with LED lighting is that the heat generated by the associated circuitry may cause damage to adjacent components and/or reduce the lifespan of the elements in the LED lighting. This is especially the case in applications requiring brighter lights, such as headlights. In those cases, the higher amount of current drawn by the circuitry may result in a greater amount of heat generated. It is therefore known to use cooling fans and/or heatsinks in order to dissipate the heat generated.

However, there are disadvantages with these cooling systems. Lamp housings in conventional vehicles are typically small in size, thus making it difficult to fit or maneuver LED lighting with bulky cooling systems within those tight confines. Although cooling fans can be made relatively small, they are also prone to failure.

Heatsinks are generally more durable. More recently, flexible heatsinks (e.g. made from flexible metal strips) have become available. However, these heatsinks are also prone to failure, such as when the metal strips become separated or detached from the body. In addition, flexible heatsinks can also take up a lot of space within the lamp housing, making installation difficult.

Another issue with LED lighting is that the light emitted by LEDs is generally directional. This means that, depending on the application, the orientation of the LEDs may be important. For example, in headlights, it is preferable that the light from the LEDs be directed away from the vehicle at particular angles in order to achieve specific light patterns. Therefore, it may be necessary to adjust the orientation of the LEDs during installation in order to ensure that the light generated is properly directed.

It is therefore desirable to provide an improved LED lamp for vehicles that is capable of both adequate heat dissipation and easier adjustability of the LEDs.

SUMMARY

According to one embodiment of the disclosure, a LED lamp for use in a lamp housing of a vehicle comprises a bulb body and a base. The bulb body comprises one or more light-emitting diodes. The base comprises a mounting portion and a heatsink portion. The mounting portion comprises a collar configured to attachably accept one end of the bulb body, and one or more mounting tabs configured to engage with the lamp housing to secure the LED lamp in place within the lamp housing. The mounting portion is integrally formed with the heatsink portion, and the bulb body is configured to be rotatable within the collar about a longitudinal axis of the LED lamp.

In another embodiment, the collar comprises a ring-shaped band.

In yet another embodiment, the collar defines a collar opening for attachably accepting the one end of the bulb body.

In still another embodiment, the heatsink portion comprises at least a first portion that is either cylindrical or frustoconical in shape.

In a further embodiment, the first portion comprises a plurality of surface undulations.

In yet a further embodiment, the heatsink portion and the mounting portion are substantially made from metal.

In still yet a further embodiment, the bulb body comprises an elongated casing for housing the one or more light-emitting diodes, and the casing comprises a tubular portion configured to be inserted into the collar opening.

In another embodiment, the collar comprises one or more fastener openings for removably receiving an adjustment fastener, and the adjustment fastener is configured to engage with a side of the tubular portion.

In yet another embodiment, the casing further comprises a flange, and the flange has a flange diameter greater than a diameter of the collar opening.

In still yet another embodiment, the bulb body comprises one or more LED circuit boards, and the light-emitting diodes are mounted on the one or more LED circuit boards.

In a further embodiment, the LED circuit boards are electrically connected to a control circuit board, and the control circuit board is housed within the heatsink portion.

In still a further embodiment, the LED lamp further comprises a power connector and a power connector housing. The power connector is electrically connected to the control circuit board and is located within the power connector housing.

In yet still a further embodiment, the power connector housing comprises a port at one end.

In yet still another embodiment, the power connector housing is integrally formed with the heatsink portion.

In another embodiment, the power connector housing extends from the heatsink portion and is oriented at an angle offset from the longitudinal axis of the LED lamp.

In yet another embodiment, the power connector housing is oriented substantially perpendicular to the longitudinal axis of the LED lamp.

In another embodiment, the power connector is electrically connected to the control circuit board through a power cord extending between the power connector and the heatsink portion.

In yet another embodiment, the heatsink portion comprises a second portion that is substantially box-shaped and extends outwardly at an angle that is substantially perpendicular to the longitudinal axis of the LED lamp.

In still yet another embodiment, the second portion comprises a plurality of fins.

In another embodiment, the LED circuit boards are electrically connected to a control circuit board.

In yet another embodiment, the LED lamp further comprises a power connector electrically connected to the control circuit board, and a housing for enclosing the control circuit board. The housing is located separate from the heatsink portion.

In still yet another embodiment, the LED lamp further comprises a first power cord portion connecting the power connector to the control circuit board, and a second power cord portion connecting the control circuit board to the heatsink portion.

In another embodiment, a LED lamp for use in a lamp housing of a vehicle comprises a bulb body and a base. The bulb body comprises one or more light-emitting diodes. The base comprises a mounting portion and a heatsink portion. The mounting portion comprises a collar configured to attachable accept one end of the bulb body, and one or more mounting tabs configured to engage with the lamp housing to secure the LED lamp in place within the lamp housing. The mounting portion is rigidly attached with the heatsink portion. The bulb body is configured to be rotatable within the collar about a longitudinal axis of the LED lamp.

The foregoing was intended as a broad summary only and of only some of the aspects of the disclosure. Other aspects of the disclosure will be more fully appreciated by reference to the detailed description and the drawings.

BRIEF DESCRIPTION OF THE DRAWINGS

The disclosure will be described by reference to the detailed description and to the drawings thereof in which.

DETAILED DESCRIPTION

Figure 1:
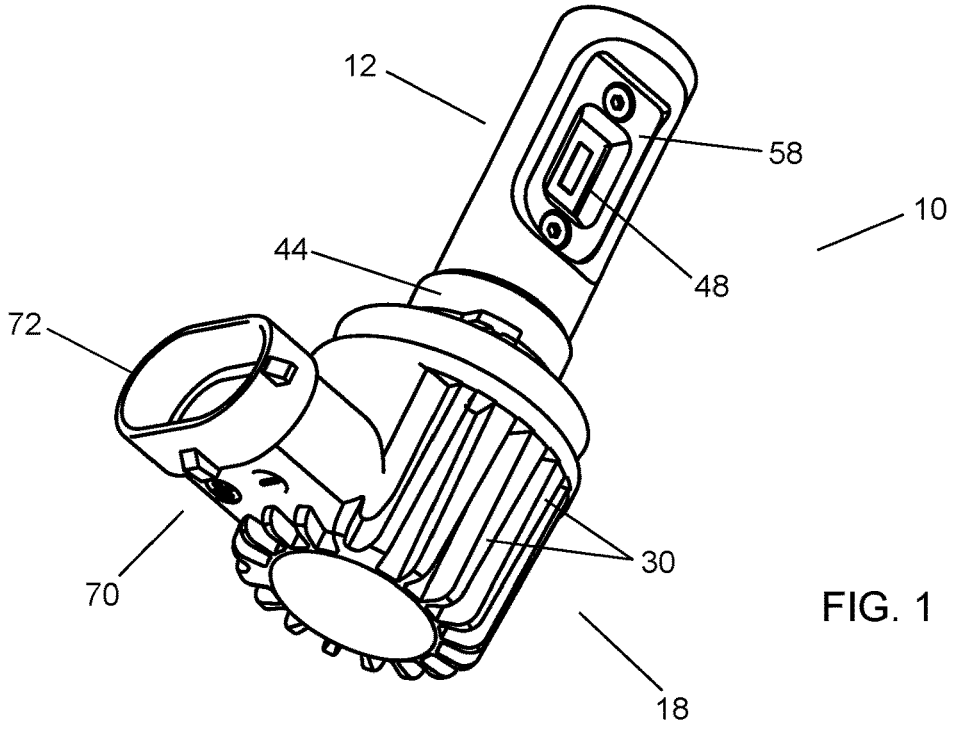
FIG. 1 is a perspective view of a LED lamp in accordance with an embodiment of the disclosure.
Figure 2:
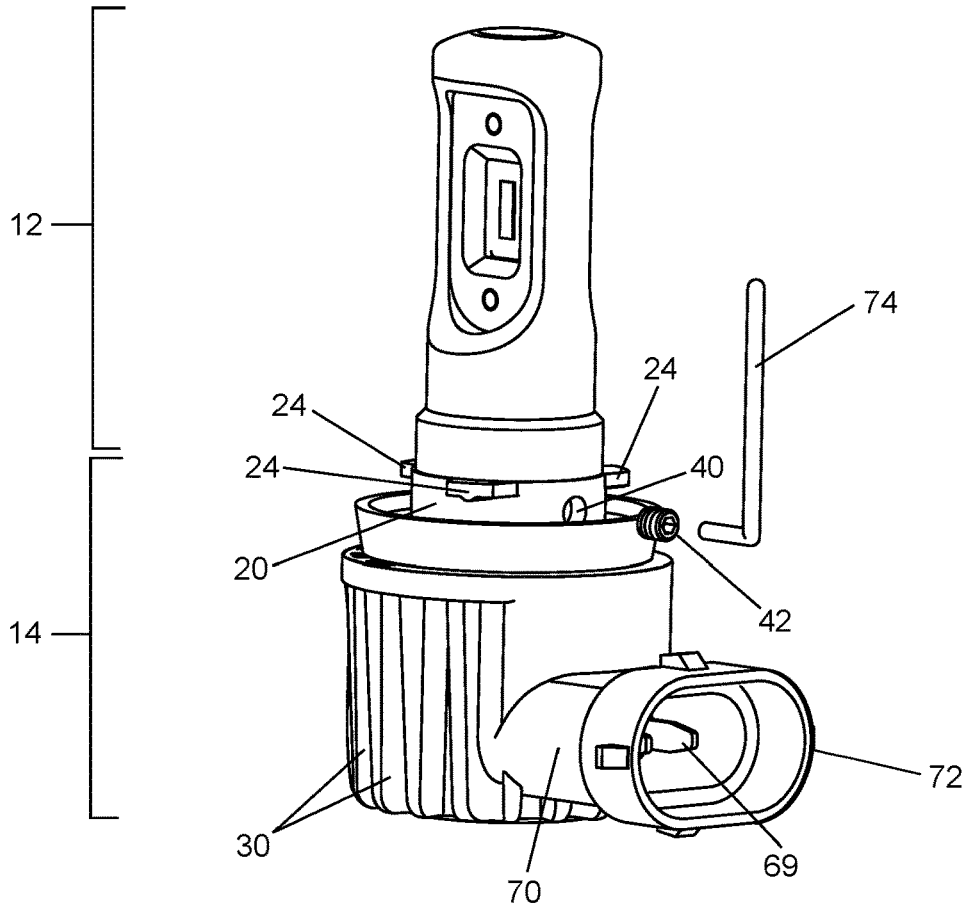
FIG. 2 is another perspective view of the LED lamp of FIG. 1.

Referring to FIGS. 1 to 9, a LED lamp 10 in accordance an embodiment of the present disclosure comprises a bulb body 12 and a base 14. The base 14 comprises a mounting portion 16 and a heatsink portion 18. Preferably, the mounting portion 16 and the heatsink portion 18 are integrally formed into a single element.

The mounting portion 16 comprises a collar 20 that is generally in the shape of a ring-shaped band and defines a collar opening 22. One or more mounting tabs 24 extend outwardly from the collar 20. In the embodiment shown in FIGS. 1 to 9, the mounting tabs 24 extend from an upper edge of the collar 20; however, it is understood that the mounting tabs 24 may extend from other locations on the collar 20 as well. The mounting tabs 24 are configured to engage with the lamp housing of a vehicle in order to hold the LED lamp 10 in place within the housing. A generally planar surface 26 may extend outwardly from the lower edge of the collar 16. An elevated rim 28 may also extend from proximate the perimeter of the planar surface 26.

Figure 4:
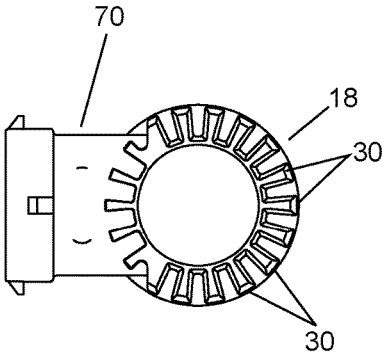
FIG. 4 is a bottom view of the LED lamp of FIG. 1.
Figure 5:
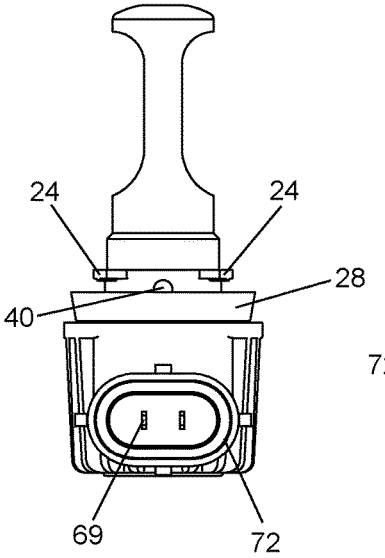
FIG. 5 is a front view of the LED lamp of FIG. 1.

At least a portion of the heatsink portion 18 may be generally cylindrical or frustoconical in shape, and within that portion, the heatsink portion comprises a plurality of surface undulations 30 that extend substantially radially (as best shown in FIG. 4). The surface undulations 30 provide additional surface area for the heatsink portion 18 to dissipate heat. This allows the heatsink portion 18 to remain relatively compact, while still providing adequate heat dissipation. Preferably, the heatsink portion 18 is made from metal (such as aluminum or copper, though other metals are also possible) in order to increase its heat dissipation properties. Where the mounting portion 16 and the heatsink portion 18 are integrally formed, the mounting portion 16 may be made from the same material as the heatsink portion 18, providing further heat dissipation effect. In another embodiment, the rim 28 may be made from rubber, while the rest of the mounting portion 16 is preferably made from metal.

Figure 8:
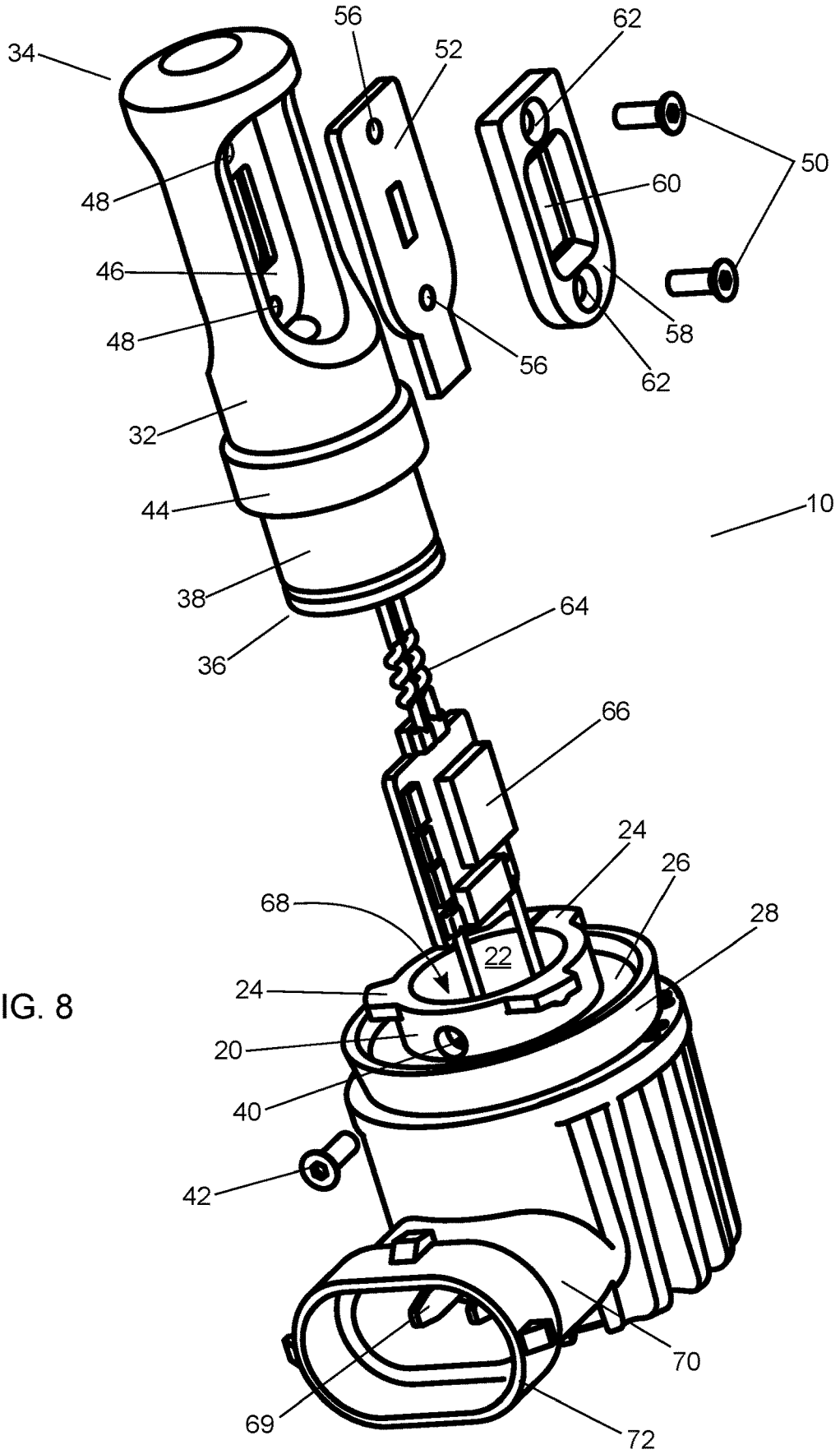
FIG. 8 is an exploded view of the LED lamp of FIG. 1.
Figure 9:
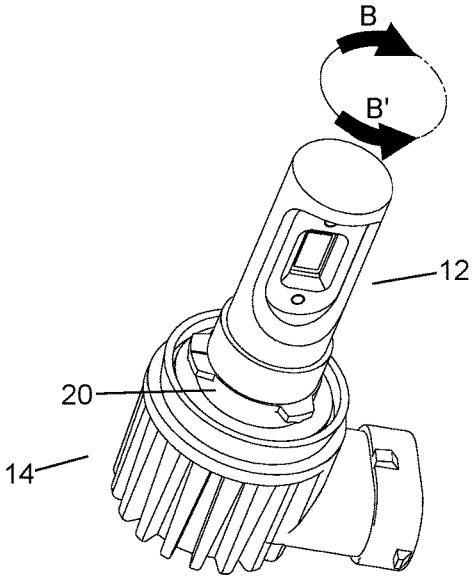
FIG. 9 is a top perspective view of the LED lamp of FIG. 1, showing the rotatability of the bulb body with respect to the base.

Referring to FIG. 8, the bulb body 12 comprises a generally elongated casing 32 comprising first and second ends 34, 36. A tubular portion 38 is located at the second end 36 and is configured to detachably engage within the collar opening 22. The tubular portion 38 extends for at least portion of the collar 20 and, preferably, extends through the entire collar 20. Preferably, the tubular portion 38 is configured to snugly fit within the collar opening 22 but still allows for the bulb body 12 to be rotatable within the collar opening 22. The collar 20 may also comprise one or more fastener openings 40 for receiving an adjustment fastener 42 (such as a screw, a bolt, or the like). When the tubular portion 38 is inserted through the collar opening 22, the adjustment fastener 42 may be tightened through the collar 20 to engage with the side of the tubular portion 38. This engagement of the adjustment fastener 42 against the tubular portion 38 fixes the tubular portion 38 (and thereby the bulb body 12) in place with respect to the collar 20 and prevents any further rotation or movement of the bulb body 12 with respect to the collar 20.

The casing 32 may also comprise a circular flange 44 above the tubular portion 38 that has a diameter greater than that of the tubular portion 38 and the collar opening 22. The flange 44 prevents the casing 32 from being inserted too deeply through the collar 20.

Referring to FIG. 8, the casing 32 comprises a mounting surface 46 proximate to the first end 34. The mounting surface 46 extends along the interior of the casing 32 and is configured to accommodate various components of the LED lamp 10. The mounting surface 46 comprises one or more mounting openings 48 for receiving a mounting fastener 50 (such as a screw, a bolt, or the like). Portions of the casing 32 are also preferably cut away to allow for the mounting of the various components of the LED lamp 10.

One or more LED circuit boards 52 may be mounted onto the mounting surface 46. Each of the LED circuit boards 52 comprises one or more light-emitting diodes 54. For example, in the embodiment shown in FIG. 8, one LED circuit board 52 is mounted on the mounting surface 46, with the LED circuit board 52 comprising one light-emitting diode 54. However, other combinations or arrangements of LED circuit boards 52 and/or light-emitting diodes 54 are also possible. For example, each LED circuit board 52 may comprise two (or more) light-emitting diodes 54. Alternatively, one LED circuit board 52 may be mounted on either side of the mounting surface 46. Each of the LED circuit board 52 also comprises one or more board openings 56 configured for engagement with the mounting fasteners 50.

Mounting plates 58 may also be provided. The mounting plates 58 are configured to fit over the LED circuit boards 52. The mounting plates 58 comprise a light opening 60 to allow light from the light-emitting diodes 54 to pass through the mounting plates 58. The mounting plates 58 also comprise one or more plate openings 62 configured for engagement with the mounting fasteners 50.

Referring to FIG. 8, the mounting plate 58 and the LED circuit board 52 may be attached to the mounting surface 46 through the mounting fasteners 50. For example, in the embodiment shown in FIG. 8, two mounting fasteners 50 secure the mounting plate 58 and the LED circuit board 52 to one side of the mounting surface 46.

The LED circuit boards 52 are electrically connected, through wires 64, to a control circuit board 66. Preferably, the heatsink portion 18 comprises an interior chamber 68 for enclosing the control circuit board 66. Heat generated by the control circuit board 66 during its operation may then be dissipated by the heatsink portion 18.

The LED lamp 10 further comprises a power connector 69 configured to provide power to the LED lamp 10. The power connector 69 is electrically connected to the control circuit board 66 and is housed within a power connector housing 70. A port 72 is located at one end of the power connector housing 70 and is configured to electrically engage with an external power source on the vehicle. In one embodiment, shown in FIGS. 1 to 9, the power connector housing 70 is integral with the heatsink portion 18. In this embodiment, the power connector housing 70 may be made from the same material as the heatsink portion 18 (e.g. made from metal) and would therefore provide heat dissipation effect as well.

Figure 6:
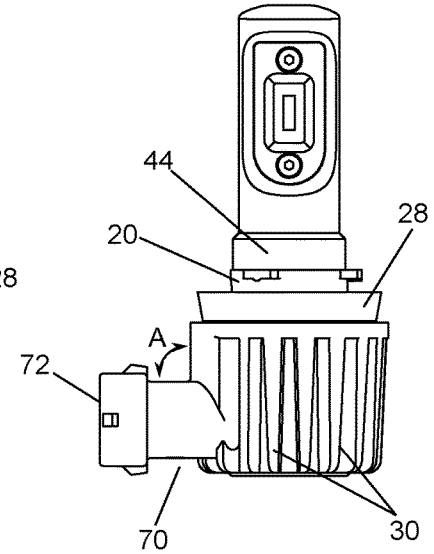
FIG. 6 is a side view of the LED lamp of FIG. 1.
Figure 7:
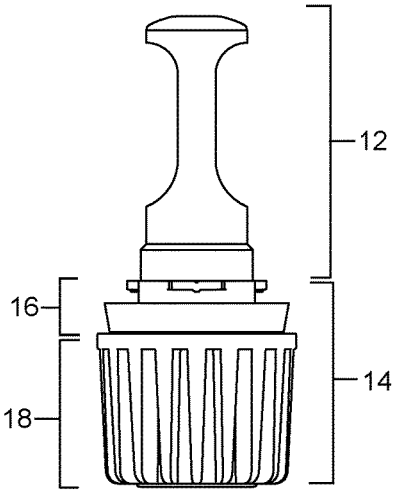
FIG. 7 is a rear view of the LED lamp of FIG. 1.

As shown in FIGS. 1 to 9, the port 72 extends from the heatsink portion 18. Preferably, the port 72 of the power connector housing 70 is oriented at an angle offset from the longitudinal axis of the LED lamp 10). For example, in the embodiment shown in FIGS. 1 to 9, the port 72 is oriented at an angle A that is substantially perpendicular to the longitudinal axis of the LED lamp 10 (as best shown in FIG. 6). This orientation and positioning of the power connector housing 70 with respect to the heatsink portion 18 allows the LED lamp 10 to resemble the shape of conventional halogen lamps for vehicles, thereby making the retrofitting of conventional vehicle lamp housings by replacing halogen lamps with the LED lamp 10 easier.

Figure 3:
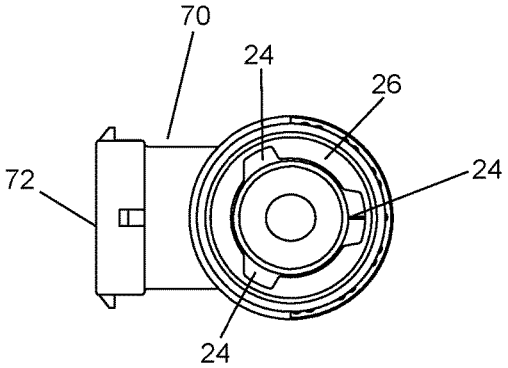
FIG. 3 is a top view of the LED lamp of FIG. 1.

Furthermore, the orientation and location of the mounting tabs 24 on the collar 24 with respect to the power connector housing 70 may also be configured so that they resemble those of conventional halogen lamps for vehicles. For example, the orientation and location of the mounting tabs 24 with respect to the power connector housing 70 as shown in FIG. 3 generally resembles those of a conventional H11 bulb.

Installation of the LED lamp 10 will now be generally described. The LED lamp 10 is positioned within the lamp housing the vehicle. By using the mounting tabs 24 on the collar 20, the LED lamp 10 may be fixed in position within the lamp housing. Depending on the positioning of the LED lamp 10 within the lamp housing, the light-emitting diodes 54 may not be oriented in an ideal position (i.e. the light generated by the light-emitting diodes 54 may be directed in a non-ideal direction). In order to correct this, the adjustment fastener 42 may be loosened within the fastener opening 40, such as by using a wrench 74. This will allow the bulb body 12 to be rotatable within the collar 20 about a longitudinal axis of the LED lamp 10, as indicated by directions B and B" in FIG. 9, for example. When the bulb body 12 has been rotated to the desired orientation with respect to the collar 20, the adjustment fastener 42 may be tightened (e.g. by using the wrench 74), thereby fixing the bulb body 12 in place. The port 72 may then be connected to the external power source of the vehicle.

Figure 10:
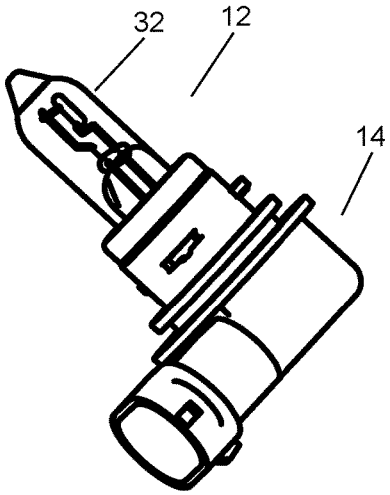
FIG. 10 is a perspective view of a second embodiment of the LED lamp.
Figure 11:
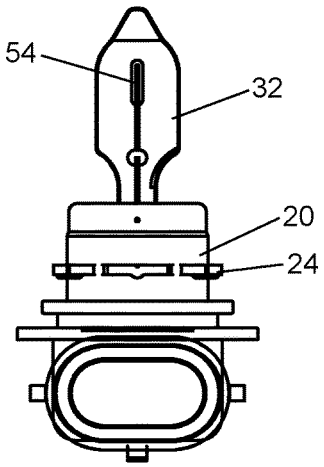
FIG. 11 is a front view of the LED lamp of FIG. 10.
Figure 12:
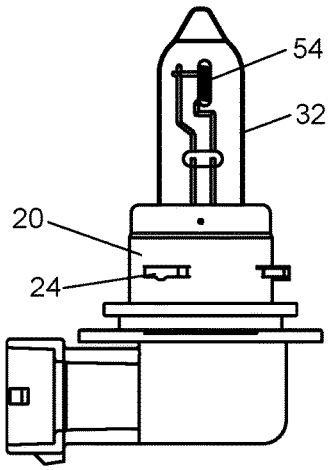
FIG. 12 is a side view of the LED lamp of FIG. 10.

FIGS. 10 to 12 depict a second embodiment of the LED lamp 10. In this embodiment, the base 14 is generally similar to that of the first embodiment. As described earlier, the mounting tabs 24 may be located away from the upper edge of the collar 20, as shown in FIG. 11, for example. In this embodiment, the casing 32 of the bulb body 12 is substantially clear or translucent. One or more of the light-emitting diodes 54 are held within the casing 32 and are configured to emit light through the casing 32.

Figure 13:
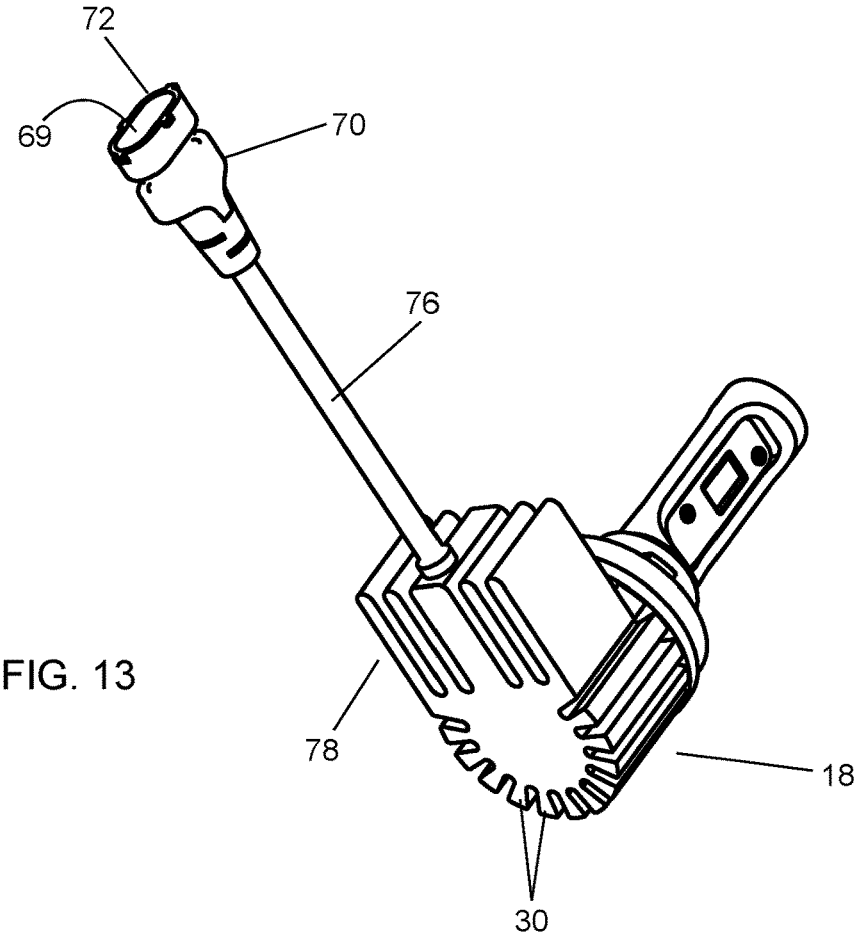
FIG. 13 is a perspective view of a third embodiment of the LED lamp.
Figure 14:
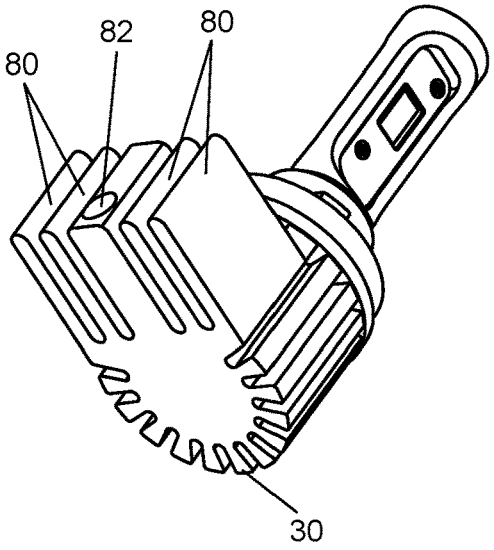
FIG. 14 is a partial perspective view of the LED lamp of FIG. 13.
Figure 15:
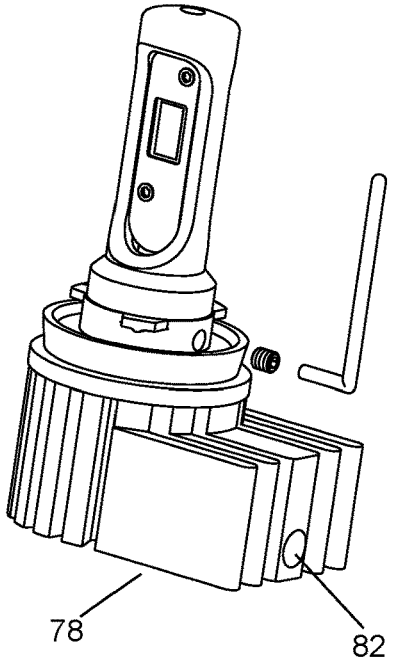
FIG. 15 is another partial perspective view of the LED lamp of FIG. 13.
Figure 16:
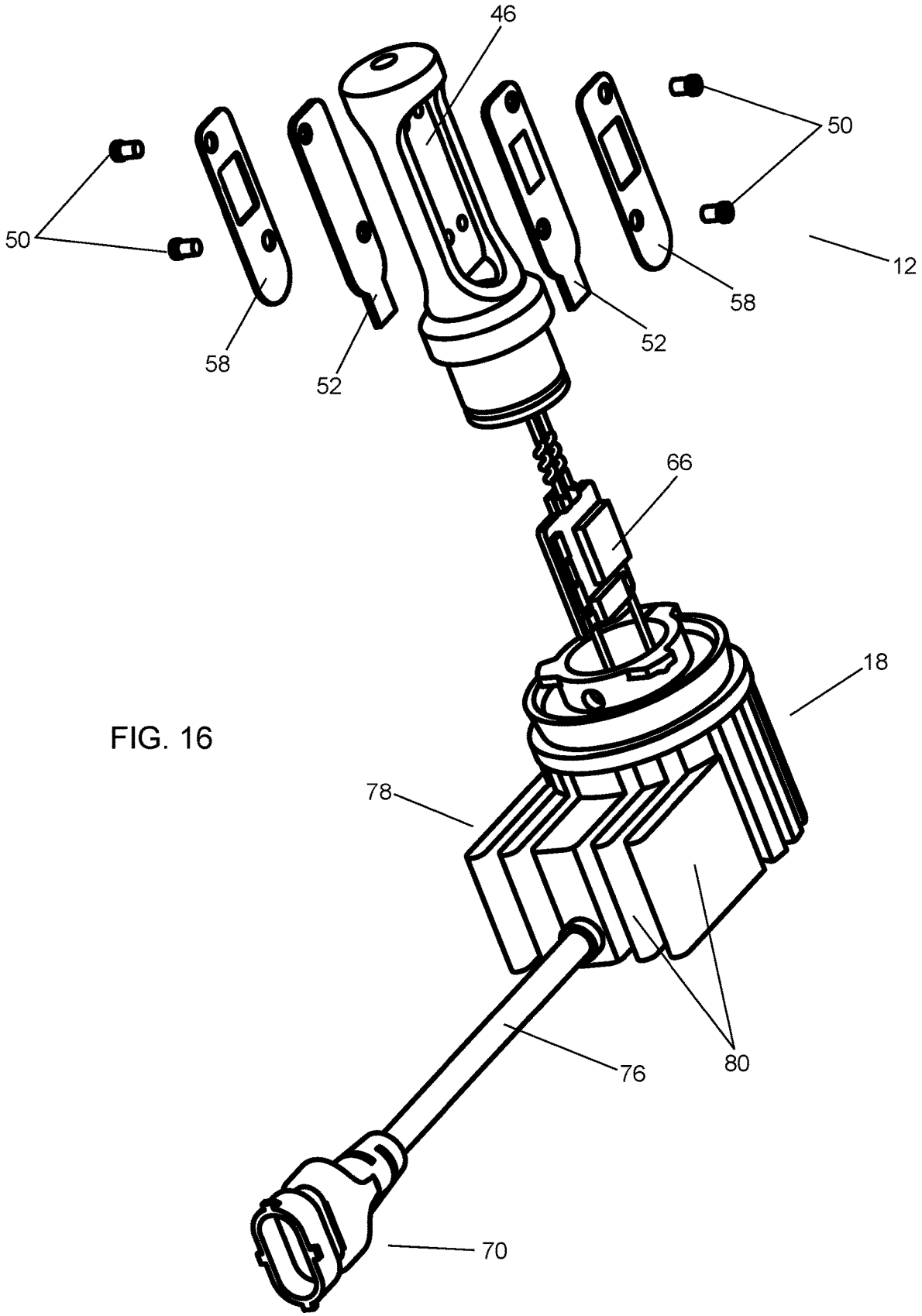
FIG. 16 is an exploded view of the LED lamp of FIG. 13.

FIGS. 13 to 16 depict a third embodiment of the LED lamp 10. In this embodiment, the power connector housing 70 is not integral with the heatsink portion 18 but is instead separate from it. The power connector 69 is electrically connected to the heatsink portion 18 through a power cord 76. As with the previous embodiments, at least a portion of the heatsink portion 18 is generally cylindrical or frustoconical in shape. However, there is at least another portion of the heatsink portion 18 that is non-cylindrical and non-frustoconical in shape. For example, as best shown in FIG. 13, at least a portion of the heatsink portion 18 comprises a box-shaped protrusion 78. This protrusion 78 generally extends outwardly, preferably substantially perpendicular to the longitudinal axis of the LED lamp 10. The protrusion 78 may comprise a plurality of outwardly-extending fins 80. The fins 80, as with the surface undulations 30, act to increase the overall surface area of the heatsink portion 18, thereby increasing its heat dissipation effect, while still allowing the heatsink portion 18 to be relatively compact.

The power cord 76 is connected to the heatsink portion 18 through a heatsink connector 82, which is preferably located on the protrusion 76. The heatsink connector 82 is electrically connected to the control circuit board 66.

As described earlier, different combinations or arrangements of LED circuit boards 52 and/or light-emitting diodes 54 for the bulb body 12 are possible. By way of example, in the embodiment shown in FIG. 16, the bulb body 12 comprises one LED circuit board 52 mounted on either side of the mounting surface 46. In addition, one mounting plate 58 may be mounted on top of each of the LED circuit board 52 (i.e. one on either side of the mounting surface 46).

Figure 17:
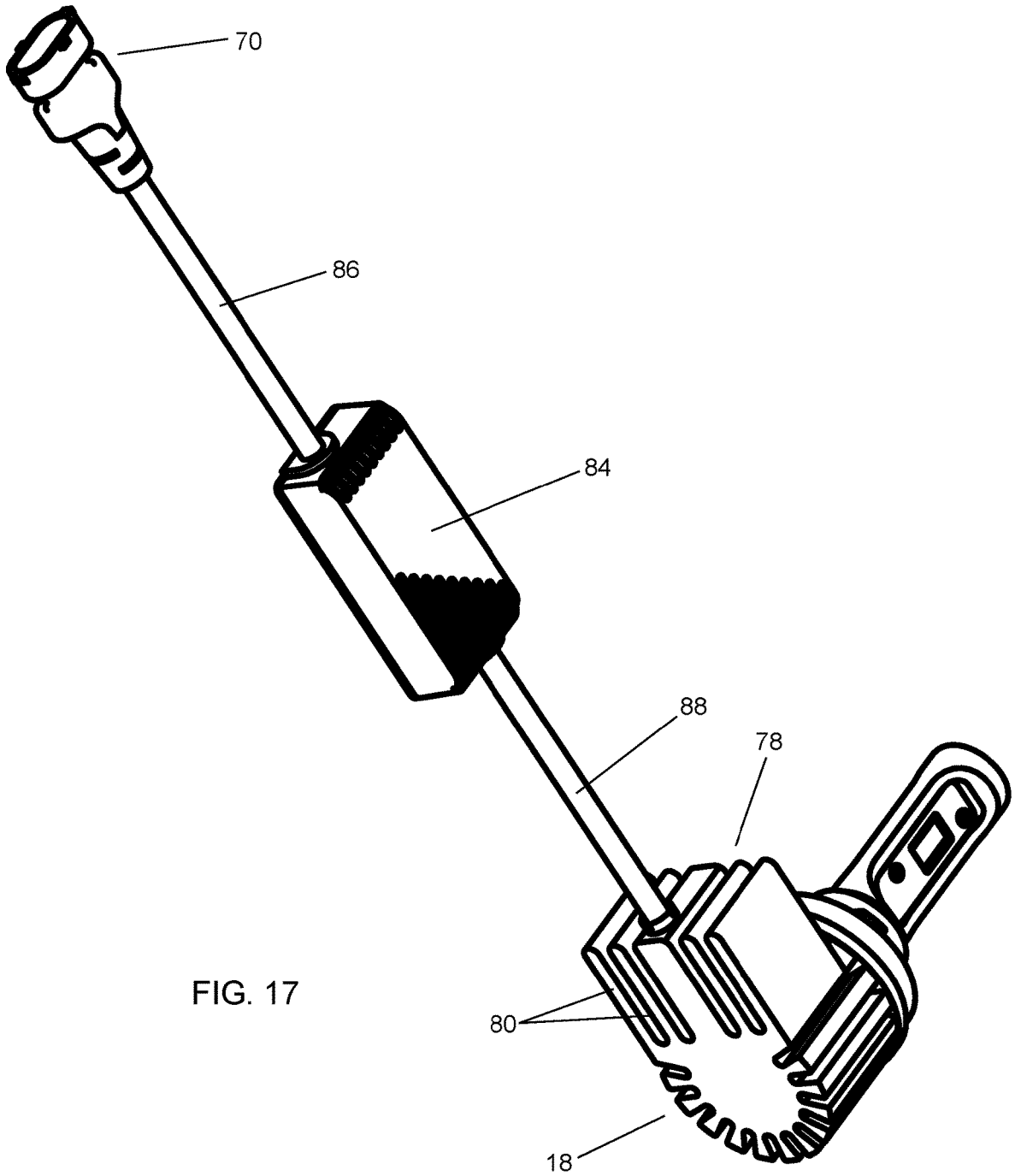
FIG. 17 is a perspective view of a fourth embodiment of the LED lamp.
Figure 18:
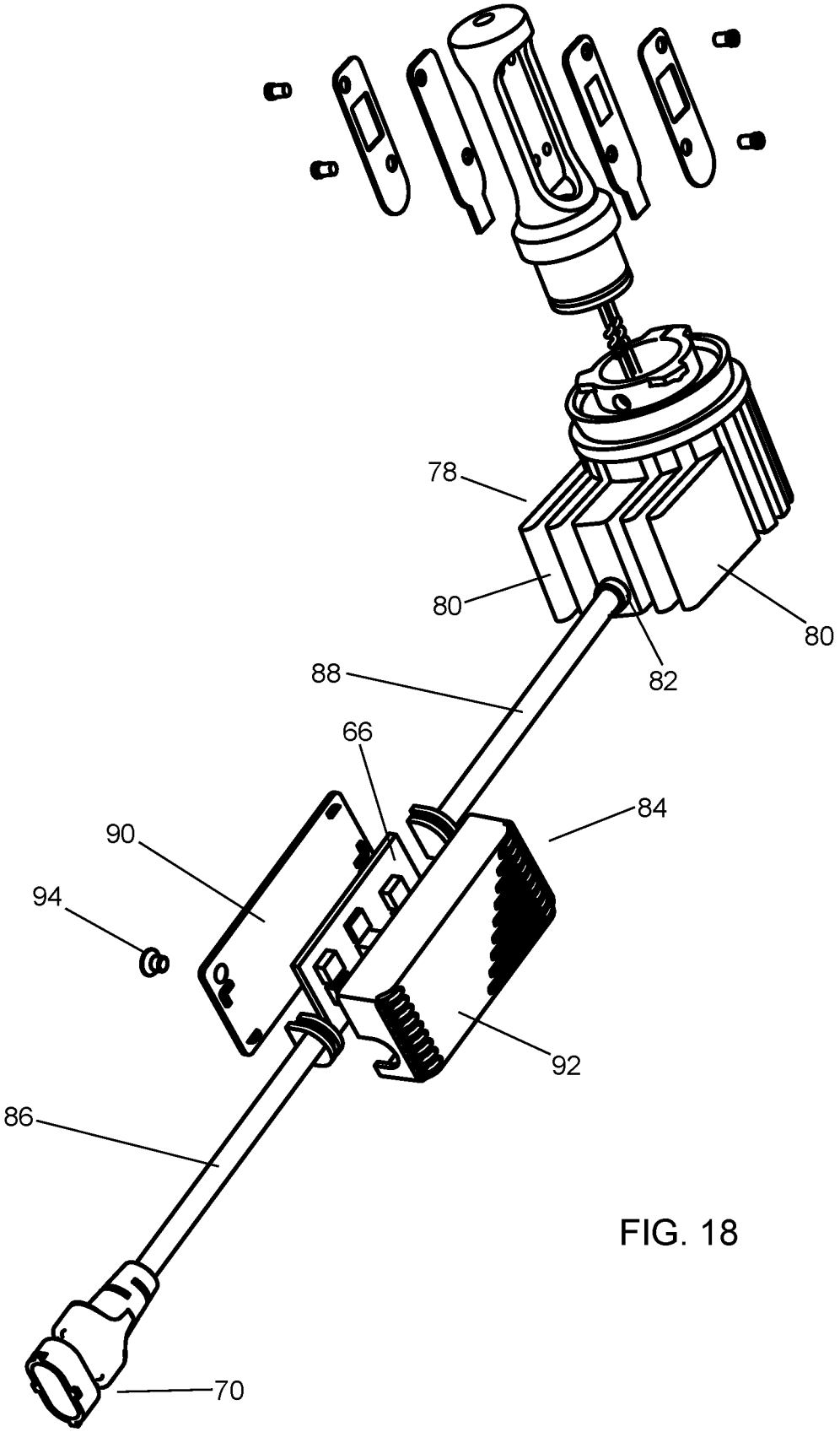
FIG. 18 is an exploded view of the LED lamp of FIG. 17.

FIGS. 17 to 18 depict a fourth embodiment of the LED lamp 10. In this embodiment, the power connector 69 is also separate from the heatsink portion 18. The protrusion 78 is also present in this embodiment and comprises fins 80.

In addition, a separate housing 84 is provided, which may be used to house the control circuit board 66. In this embodiment, the control circuit board 66 is not located within the interior chamber 68 of heatsink portion 18 but is instead located outside of the heatsink portion 18 (as best shown in FIG. 18). The housing 84 is separated from the power connector housing 70 and the heatsink portion 18 through first and second power cord portions 86, 88. The first power cord portion 86 connects the power connector 69 to the circuit board 66 (within the housing 84), while the second power cord portion 88 connects the circuit board 66 to the heatsink portion 18 (through heatsink connector 82).

The housing 84 may comprise a plate 90 and a cover 92 configured to fit over the plate 90. Housing fasteners 94 may be provided to secure the plate 90 and the cover 92 together.

Figure 19:
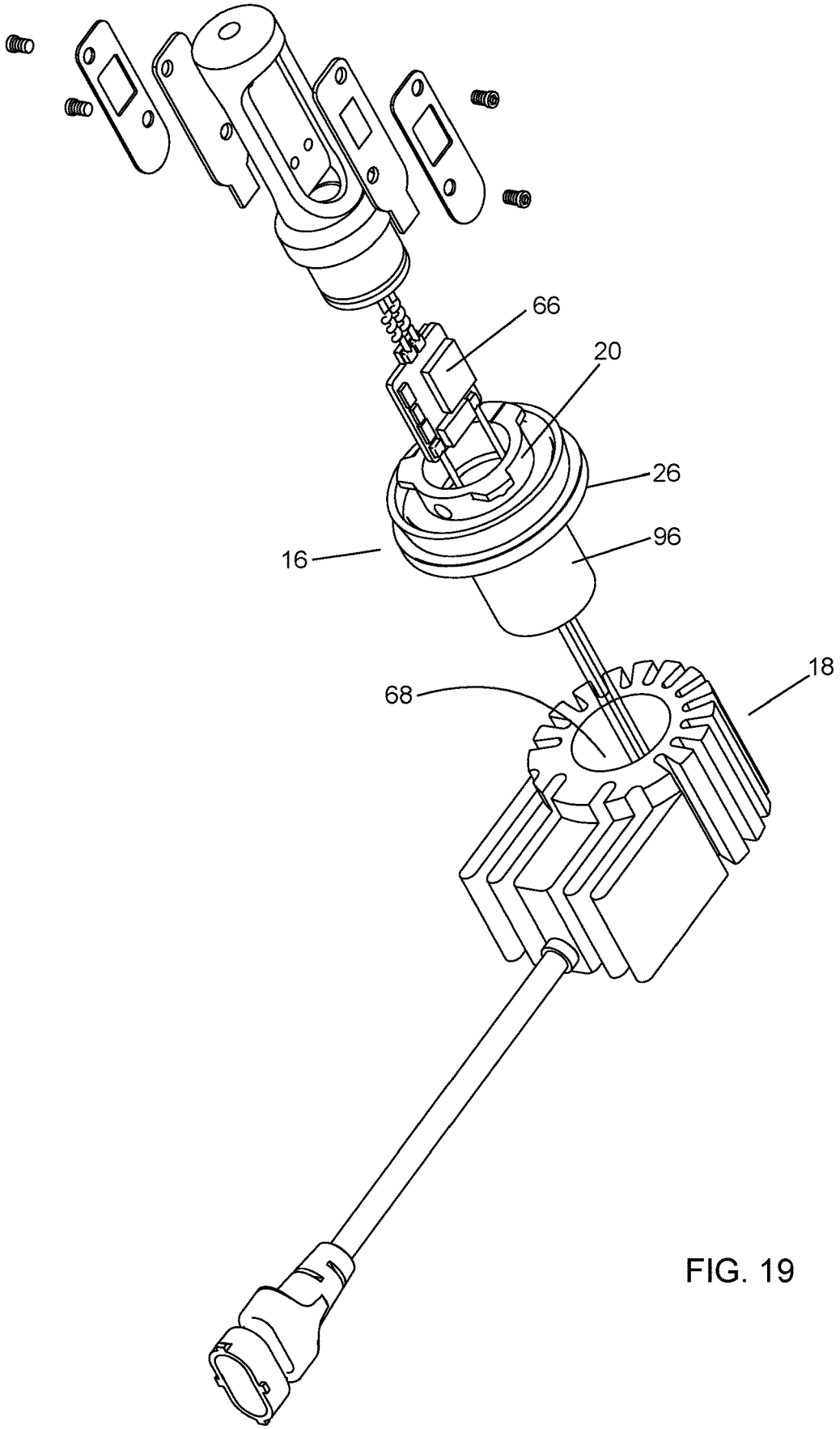
FIG. 19 is an exploded view of a fifth embodiment of the LED lamp.

In a fifth embodiment of the LED lamp 10, shown in exploded view in FIG. 19, the mounting portion 16 is not integrally formed with the heatsink portion 18. Instead, the mounting portion 16 comprises a substantially hollow neck 96 extending away from the planar surface 26 (in a direction opposite to the collar 20). The neck 96 is configured to fit within the interior chamber 68 of the heatsink portion 18. Once the neck 96 has been inserted into the interior chamber 68, the neck 96 is preferably fixed in place with respect to the heatsink portion 18, such as by using a friction fit, an adhesive, or some other fastening means. The control circuit board 66 may be inserted through the neck 96. Because the neck 96 (and thereby the mounting portion 16) is held in place with respect to the heatsink portion 18, the collar 20 is also fixed with respect to the heatsink portion 18, similar to the previous embodiments.

Figure 20:
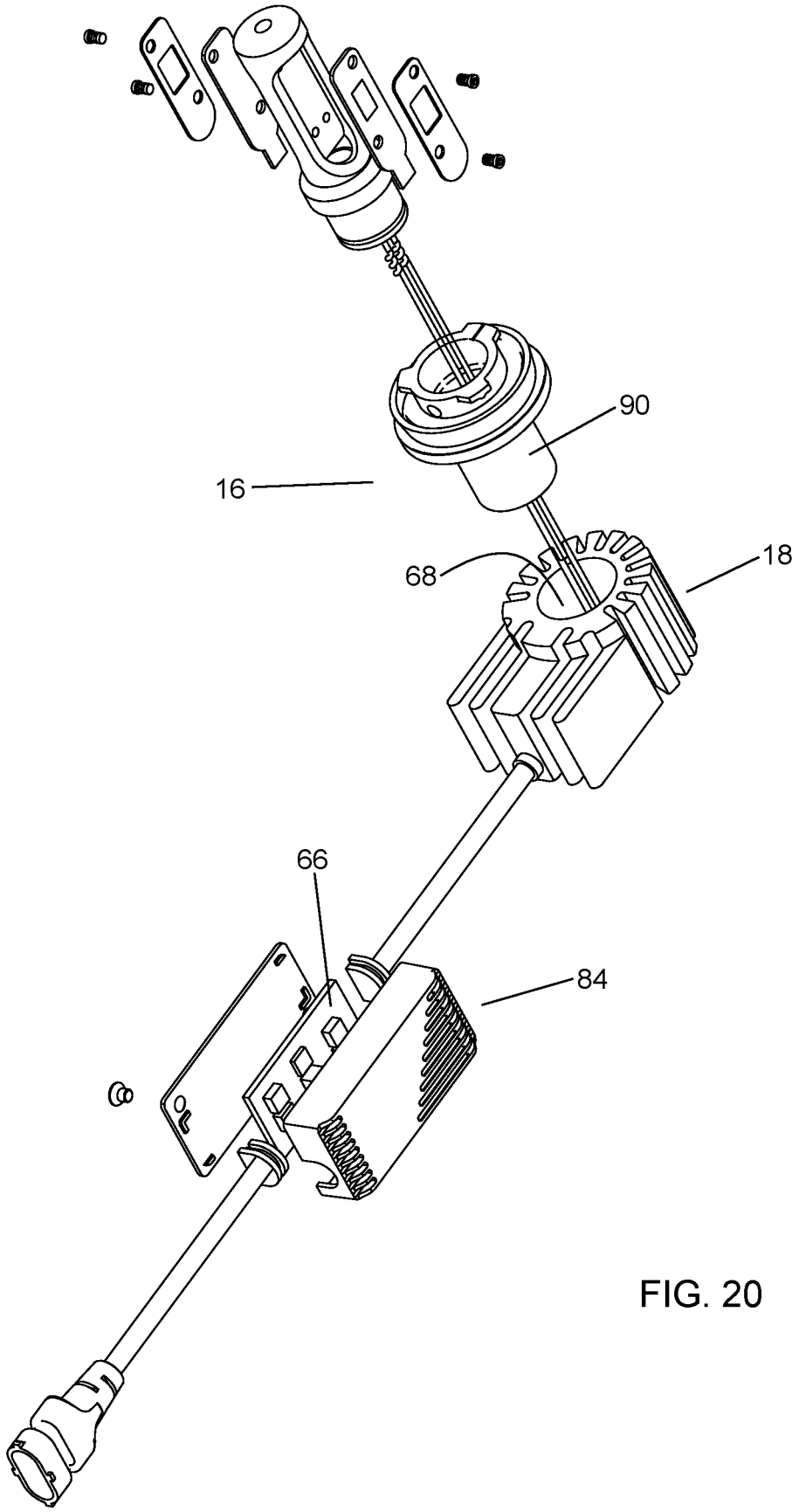
FIG. 20 is an exploded view of a sixth embodiment of the LED lamp.

FIG. 20 shows a sixth embodiment of the LED lamp 10 in exploded view. This embodiment is similar to the fifth embodiment, described above, except that the control circuit board 66 is located in the separate housing 84. Otherwise, in this embodiment, the mounting portion 16 also comprises the neck 96 that is configured to fit within the interior chamber 68 of the heatsink portion 18.

It will be appreciated that in all of the described embodiments, the mounting portion 16 is fixed in position with respect to the heatsink portion 18, either by being formed as an integral unit or fixed by some other means. As a result, the collar 20 is fixed with respect to the heatsink portion 18. Once the collar 20 has been attached to the lamp housing of the vehicle (through the mounting tabs 24), any further movement of the heatsink portion 18 is no longer possible. However, the orientation of the light-emitting diodes 54 can still be adjusted (through rotation of the bulb body 12 with respect to the collar 20).

The installation of the LED lamp 10 is therefore made easier. The space provided by typical lamp housings in vehicles is limited, and it is often necessary to maneuver or angle the heatsink portion 18 into specific orientations in order to fit within the lamp housing. In conventional LED lamps, when the orientation of the light-emitting diode(s) is adjusted (to provide proper directionality), the orientation of the heatsink and/or fan is in turn affected as well, which may result in the heatsink and/or fan no longer fitting properly within the lamp housing. The LED lamp 10 of this disclosure allows for the light-emitting diodes 54 to be rotated independently of the heatsink portion 18.

In the foregoing description, exemplary modes for carrying out the disclosure in terms of examples have been described. However, the scope of the claims should not be limited by those examples but should be given the broadest interpretation consistent with the description as a whole. The specification and drawings are, accordingly, to be regarded in an illustrative rather than a restrictive sense.

The invention claimed is:

1. A light-emitting diode (LED) lamp for use in a lamp housing of a vehicle, the LED lamp comprising: a bulb body comprising one or more light-emitting diodes; one or more circuit boards connected to the one or more light-emitting diodes; and a base comprising: a mounting portion comprising: a collar defining a collar opening configured to attachably accept one end of the bulb body, and one or more mounting tabs extending outward from the collar and configured to engage with the lamp housing to secure the LED lamp in place within the lamp housing; and a heatsink portion extending from the collar in a direction opposite to the mounting portion, wherein the heatsink portion defines an interior chamber extending from the collar opening, and at least one end of the one or the one or more circuit boards is housed in the interior chamber and another end of the one or more circuit boards extends through the collar opening into the bulb body; wherein the mounting portion is integrally formed with the heatsink portion.

2. The LED lamp of claim 1, wherein the bulb body comprises an elongated casing for housing the one or more light-emitting diodes, wherein the casing comprises a tubular portion configured to be inserted into the collar opening.

3. The LED lamp of claim 2, wherein the one or more circuit boards comprise one or more LED circuit boards and wherein the light-emitting diodes are mounted on the one or more LED circuit boards.

4. The LED lamp of claim 3, wherein the one or more LED circuit boards are electrically connected to a control circuit board.

5. The LED lamp of claim 4, further comprising:

a power connector electrically connected to the control circuit board; and a housing for enclosing the control circuit board, wherein the housing is located separate from the heatsink portion.

6. The LED lamp of claim 5, further comprising a first power cord portion connecting the power connector to the control circuit board, and a second power cord portion connecting the control circuit board to the heatsink portion.

7. The LED lamp of claim 3, wherein the one or more circuit boards further comprise a control circuit board, and the LED circuit boards are electrically connected to the control circuit board, wherein the control circuit board is housed within the heatsink portion.

8. The LED lamp of claim 2, wherein the collar comprises one or more fastener openings for removably receiving an adjustment fastener, wherein the adjustment fastener is configured to engage with a side of the tubular portion.

9. The LED lamp of claim 8, wherein the casing further comprises a flange, wherein the flange has a flange diameter greater than a diameter of the collar opening.

10. The LED lamp of claim 1, further comprising:

a power connector electrically connected to the one or more circuit boards; and a power connector housing, wherein the power connector is located within the power connector housing.

11. The LED lamp of claim 10, wherein the power connector housing is integrally formed with the heatsink portion.

12. The LED lamp of claim 11, wherein the power connector housing extends from the heatsink portion and is oriented at an angle offset from the longitudinal axis of the bulb body.

13. The LED lamp of claim 12, wherein the power connector housing is oriented substantially perpendicular to the longitudinal axis of the bulb body.

14. The LED lamp of claim 10, wherein the power connector is electrically connected to the one or more circuit boards through a power cord extending between the power connector and the heatsink portion.

15. The LED lamp of claim 14, wherein the heatsink portion comprises a second portion that is substantially box-shaped and extends outwardly at an angle that is substantially perpendicular to the longitudinal axis of the bulb body.

16. The LED lamp of claim 15, wherein the second portion comprises a plurality of fins.

17. The LED lamp of claim 10, wherein the power connector housing comprises a port at one end.

18. The LED lamp of claim 1, wherein the heatsink portion comprises at least a first portion that is either cylindrical or frustoconical in shape.

19. The LED lamp of claim 18, wherein the first portion comprises a plurality of surface undulations.

20. The LED lamp of claim 1, wherein the collar comprises a ring-shaped band.

21. The LED lamp of claim 1, wherein the heatsink portion and the mounting portion are substantially made from metal.

22. A light-emitting diode (LED) lamp for use in a lamp housing of a vehicle, the LED lamp comprising: a bulb body comprising one or more light-emitting diodes; one or more circuit boards connected to the one or more light-emitting diodes; and a base comprising: a mounting portion comprising: a collar defining a collar opening configured to attachably accept one end of the bulb body, and one or more mounting tabs extending outward from the collar and configured to engage with the lamp housing to secure the LED lamp in place within the lamp housing; and a heatsink portion extending from the collar in a direction opposite to the mounting portion, wherein the heatsink portion defines an interior chamber extending from the collar opening, and at least one end of the one or the one or more circuit boards is housed in the interior chamber and another end of the one or more circuit boards extends through the collar opening into the bulb body; wherein the mounting portion is integrally formed with the heatsink portion.

* * * * *